US008973462B2

(12) United States Patent
Olajos et al.

(10) Patent No.: US 8,973,462 B2
(45) Date of Patent: Mar. 10, 2015

(54) PEDAL ASSEMBLY HAVING A PEDAL ARM RELEASE

(71) Applicants: Michael D. Olajos, South Woodslee (CA); Derreck Robert Heipel, Ridgetown (CA)

(72) Inventors: Michael D. Olajos, South Woodslee (CA); Derreck Robert Heipel, Ridgetown (CA)

(73) Assignee: KSR IP Holdings LLC., Wilmington, DE (US)

( * ) Notice: Subject to any disclaimer, the term of this patent is extended or adjusted under 35 U.S.C. 154(b) by 0 days.

(21) Appl. No.: 13/834,078

(22) Filed: Mar. 15, 2013

(65) Prior Publication Data

US 2013/0239738 A1 Sep. 19, 2013

Related U.S. Application Data

(60) Provisional application No. 61/611,275, filed on Mar. 15, 2012.

(51) Int. Cl.
*G05G 1/327* (2008.04)

(52) U.S. Cl.
CPC ..... *G05G 1/327* (2013.01)
USPC ..... 74/512; 74/560

(58) Field of Classification Search
CPC ..... B60R 21/09; G05G 1/405; G05G 1/30; B60T 7/065
USPC ..... 74/512–514, 560
See application file for complete search history.

(56) References Cited

U.S. PATENT DOCUMENTS 5,921,144 A * 7/1999 Williams et al. ..... 74/512
6,752,038 B2 6/2004 Cordero
6,786,109 B2 9/2004 Mueller et al.
6,889,791 B2 5/2005 Watanabe
7,077,028 B2 7/2006 Misonou et al.
7,090,046 B2 8/2006 Nebuya et al.

(Continued)

FOREIGN PATENT DOCUMENTS

CN 101982354 A 3/2011
EP 0827885 A1 3/1998

(Continued)

OTHER PUBLICATIONS

EPO Machine Translation of KR 2010 0014222, Alonso et al., Oct. 2010.*

(Continued)

*Primary Examiner* — Vinh Luong
(74) *Attorney, Agent, or Firm* — Gifford, Krass, Sprinkle, Anderson & Citkowski, P.C.

(57) ABSTRACT

The pedal assembly is provided for an automotive vehicle having a mounting bracket and a stationary cross member. The pedal assembly includes a swing bracket, a striker plate, and a pedal arm. The swing bracket is pivotally mounted to the mounting bracket about a pedal pivot axis. The striker plate is pivotally connected to the swing bracket. The pedal arm includes a primary pivotal connection to the swing bracket at a first pivot axis. The pedal arm includes a secondary connection to at least one of the striker plate and the swing bracket, to allow the entire pedal assembly to pivot about the pedal pivot axis upon depression of the pedal pad. During a vehicle collision of sufficient magnitude, the cross member collides against and forcibly rotates the striker plate which disengages the secondary connection to allow the pedal arm to freely pivot about the first pivot axis.

3 Claims, 10 Drawing Sheets

(56) References Cited

U.S. PATENT DOCUMENTS

| | | | | |
|---|---|---|---|---|
| 7,228,759 | B2 | 6/2007 | Jagger et al. | |
| 7,240,581 | B2 | 7/2007 | Lee | |
| 7,415,909 | B2 | 8/2008 | Miyoshi et al. | |
| 7,434,648 | B2 | 10/2008 | Hayashi | |
| 7,497,144 | B2 | 3/2009 | Yoon | |
| 7,516,683 | B2 | 4/2009 | Jasseron | |
| 7,568,545 | B2 | 8/2009 | Tanigawa et al. | |
| 7,665,387 | B2 | 2/2010 | Park | |
| 7,665,565 | B2 | 2/2010 | Tokumo et al. | |
| 7,775,555 | B2 | 8/2010 | Allen et al. | |
| 7,849,950 | B2 | 12/2010 | Hatakenaka et al. | |
| 7,987,743 | B2 | 8/2011 | Sukonthapanich | |
| 8,196,695 | B2 * | 6/2012 | Kim et al. | 180/274 |
| 2002/0179359 | A1 | 12/2002 | Kawai et al. | |
| 2006/0070487 | A1 * | 4/2006 | Hayashi | 74/560 |
| 2007/0227289 | A1 | 10/2007 | Choi et al. | |
| 2010/0089198 | A1 | 4/2010 | Fujioka et al. | |
| 2011/0030500 | A1 * | 2/2011 | Tokumo et al. | 74/512 |
| 2013/0125698 | A1 * | 5/2013 | Burguera Albizuri et al. | 74/560 |

FOREIGN PATENT DOCUMENTS

| | | | | | |
|---|---|---|---|---|---|
| EP | 1074445 | A2 | | 2/2001 | |
| EP | 1247710 | A1 | | 10/2002 | |
| EP | 1308357 | A1 | | 5/2003 | |
| EP | 1318051 | A2 | | 6/2003 | |
| EP | 1323602 | A1 | * | 7/2003 | B60T 7/06 |
| EP | 1371525 | A2 | | 12/2003 | |
| EP | 1557330 | A2 | | 7/2005 | |
| EP | 1600344 | A1 | | 11/2005 | |
| FR | 2843569 | A1 | | 2/2004 | |
| FR | 2885574 | A1 | | 11/2006 | |
| FR | 2899174 | A1 | | 10/2007 | |
| JP | 2002187536 | A | | 2/2002 | |
| JP | 2004157792 | A | | 3/2004 | |
| KR | 2010 0014222 | | * | 10/2010 | B60K 26/02 |
| WO | WO 2007/096079 | | * | 8/2007 | B60R 21/09 |
| WO | 2008142193 | A1 | | 11/2008 | |

OTHER PUBLICATIONS

International Search Report and Written Opinion, International Application No. PCT/IB2013/000394, Aug. 7, 2013.

* cited by examiner

PEDAL ASSEMBLY HAVING A PEDAL ARM RELEASE

CROSS-REFERENCE TO RELATED APPLICATIONS

This application claims priority to U.S. Provisional Patent Application 61/611,275 filed Mar. 15, 2012, the contents of which are incorporated herein by reference.

FIELD OF THE INVENTION

The present invention relates generally to pedal assemblies. More particularly, the invention relates to pedal assemblies having pedal arms which release during vehicle collisions.

BACKGROUND OF THE INVENTION

In the event that a vehicle is involved in a frontal crash, a driver often has a foot on or near the brake and/or clutch pedal. However, if the frontal vehicular crash is of sufficient magnitude, the impact force of the crash will often push the front portion of the vehicle towards the rear portion. In these situations the mechanically connected brake or clutch pedal acts as a rigid member and transfers the force of the crushing impact to the foot and leg of the driver. Such force transfer is often able to injure the driver due to the impact force or trapping a portion of the driver due to the reduction in space caused by the rearward movement of the brake pedal.

Although it is known to provide assemblies that disengage the pedal from the mechanical connection so as to avoid these injuries, the previously known disengagement mechanisms are complex. Due to the complexity, the previously known disengagement mechanisms are often heavy and require additional time and expense to assembly and install. As such, the overall weight and cost of the vehicle is increased.

Thus, there exists a need for an improved pedal assembly operable to disengage the pedal during a vehicle collision, which provides a reduction in weight and installation time and expense.

SUMMARY OF THE INVENTION

The present invention provides a pedal release assembly having a releasable pedal arm, which overcomes the above mentioned disadvantages of the previously known disengageable pedal assemblies. The present invention provides a pedal assembly with a releasable pedal arm which reduces overall weight and complexity of the pedal assembly.

In brief, the pedal assembly is provided for an automotive vehicle having a mounting bracket and a stationary cross member. The pedal assembly includes a swing bracket, a striker plate, and a pedal arm. The swing bracket is pivotally mounted to the mounting bracket about a pedal pivot axis. The striker plate is pivotally connected to the swing bracket. The pedal arm includes a primary pivotal connection to the swing bracket at a first pivot axis. The pedal arm having a secondary connection to at least one of the striker plate and the swing bracket to allow the entire pedal assembly to pivot about the pedal pivot axis upon depression of the pedal pad. During a vehicle collision of sufficient magnitude, the cross member collides against and forcibly rotates the striker plate which disengages the secondary connection to allow the pedal arm to freely pivot about the first pivot axis.

BRIEF DESCRIPTION OF THE DRAWINGS

A better understanding of the present invention will be had upon reference to the following detailed description when read in conjunction with the accompanying drawings wherein like reference characters refer to like parts throughout the several views and in which.

DETAILED DESCRIPTION OF THE INVENTION

The present invention has utility as a pedal assembly that releases the pedal arm upon a vehicle collision of sufficient magnitude. By providing a striker plate that has a secondary connection to a pedal arm, which prevents free rotation of the pedal arm about a first pivot axis while allowing rotation of the entire pedal assembly about the pedal pivot axis, to rotate upon application of a predetermined force by a cross member to disengages the secondary connection allows for a reduction in complexity and a decrease in overall weight of the pedal assembly.

Figure 1:
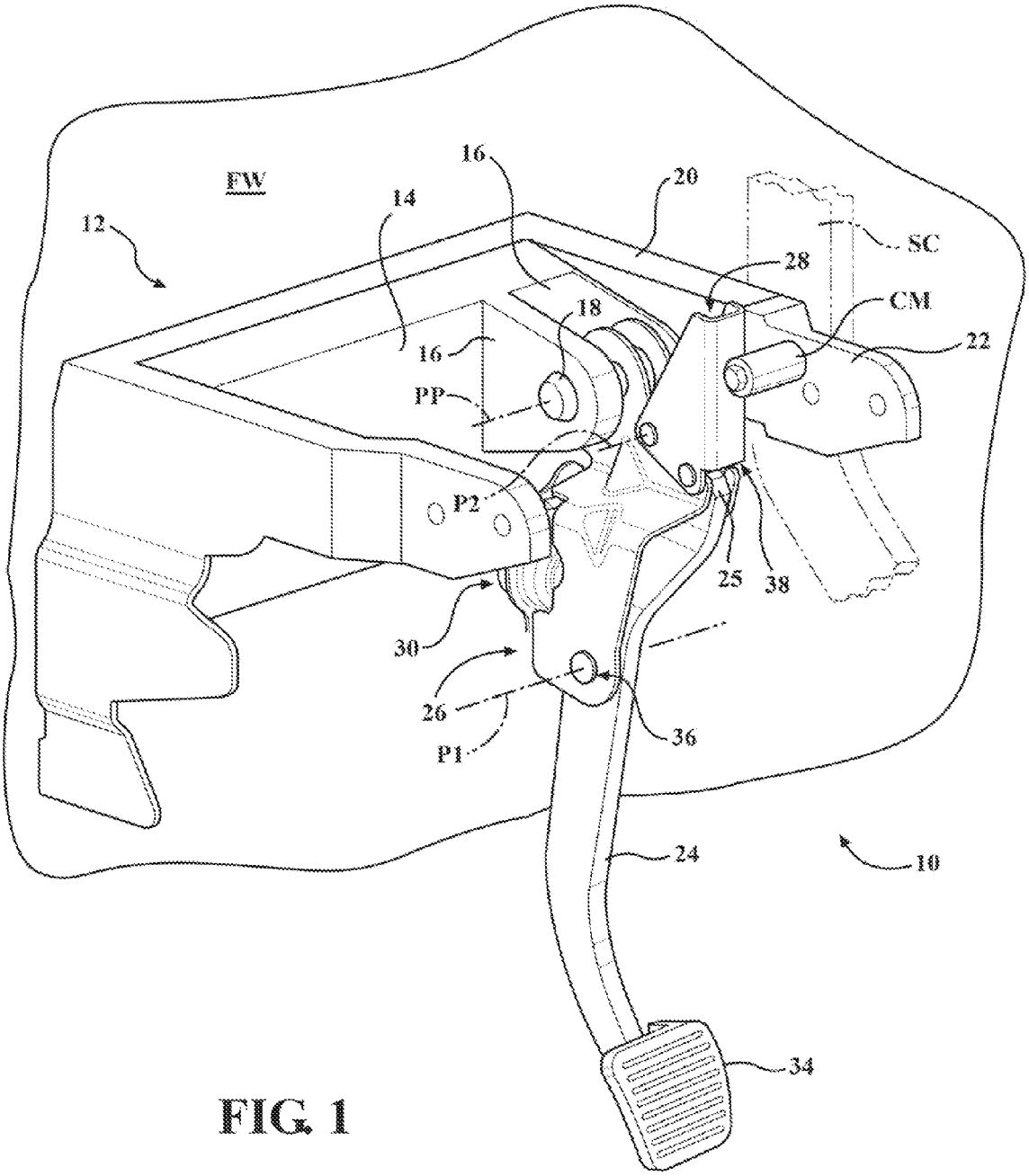
FIG. 1 is a perspective view illustrating the pedal assembly mounted to the vehicle.

With reference to FIG. 1, an improved pedal assembly which overcomes the above described disadvantages of the previously known brake pedals is generally illustrated at 10. The pedal assembly 10 includes a mounting bracket 12 that is attached to a portion of a vehicle such as a dash panel or a firewall FW. The mounting bracket 12 includes a mounting plate 14 having one side mounted to the firewall FW, and a pair of arms 16 extending outwardly from an opposite side of the mounting plate 14. As will be described in greater detail below, a pivoting member 18, such as a pin or rod, extends through apertures formed in each of the pair of mounting arms 16. It is appreciated, of course, that the mounting bracket 12 may be a bracket to mount a single pedal or multi-pedals in which case several pairs of arms 16 extend outwardly from the mounting plate 14.

In the illustrated embodiment of FIG. 1, the mounting bracket 12 includes a strut 20 that extends outwardly from the mounting plate 14. A break tab 22 is provided at an end of the strut 20. As will be described in greater detail below, the break tab 22 is designed to rupture and fracture from the strut 20 during a vehicle collision of sufficient magnitude. The break tab 22 optionally includes a cross-member CM which that extends in a vehicle width direction and is provided rearwardly of the pedal assembly 10 in a vehicle longitudinal direction. After the mounting bracket 12, either with or without the pedal assembly 10, is mounted to the firewall FW, the cross-member CM is the bolted, welded, or otherwise fixedly secured to a structural component SC of the vehicle. The structural component SC is a structural component of the vehicle separate from the either the mounting bracket 12 or the pedal assembly 10, such as the instrument panel.

By initially providing the cross-member CM as a portion of the mounting bracket 12, the entire assembly can be easily installed in various vehicles which otherwise lacks a structural component SC and cross-member CM in a required position aligned with the pedal assembly 10 and mounting bracket 12. During a vehicle collision of sufficient magnitude, the forceful displacement of the front end of the vehicle towards the rear end of the vehicle, in the vehicle longitudinal direction, ruptures the break tab 22 such that the cross-member CM remains relatively stationary, with respect to the pedal assembly 10 and mounting bracket 12, and fixedly secured to the structural component SC.

Figure 5C:
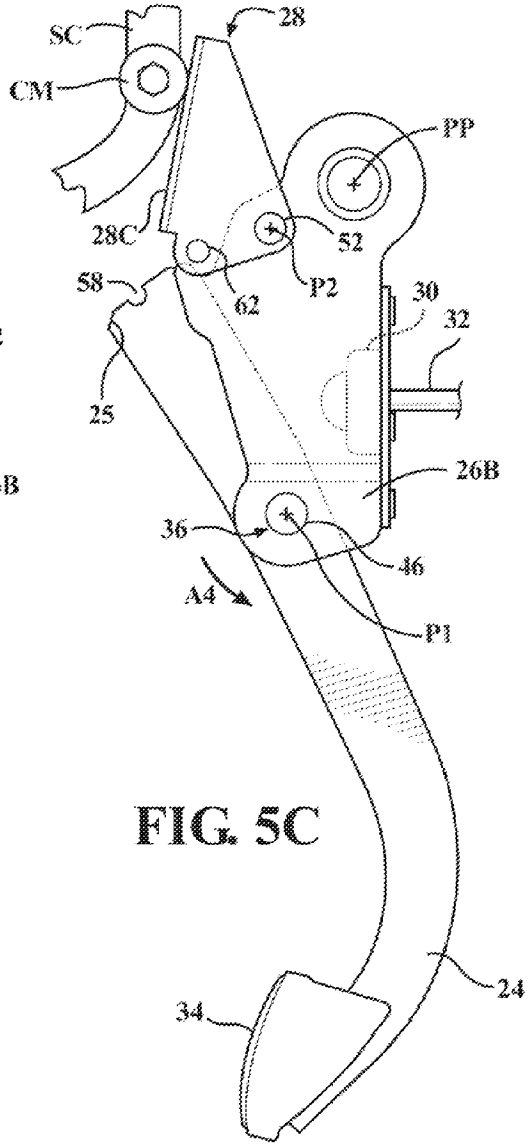
FIGS. 5A-5C are side views illustrating the operation of the pedal assembly during a vehicle collision.
Figure 5B:
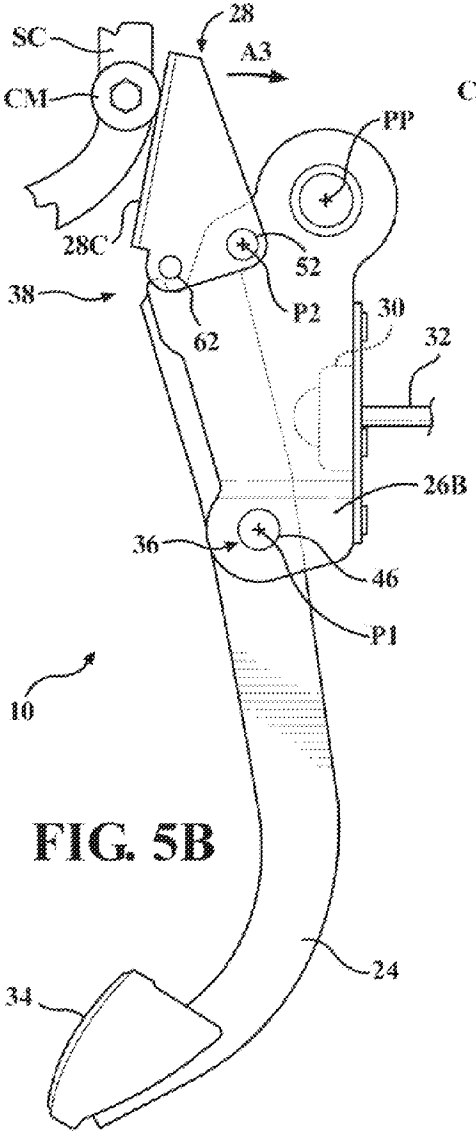
Figure 5A:
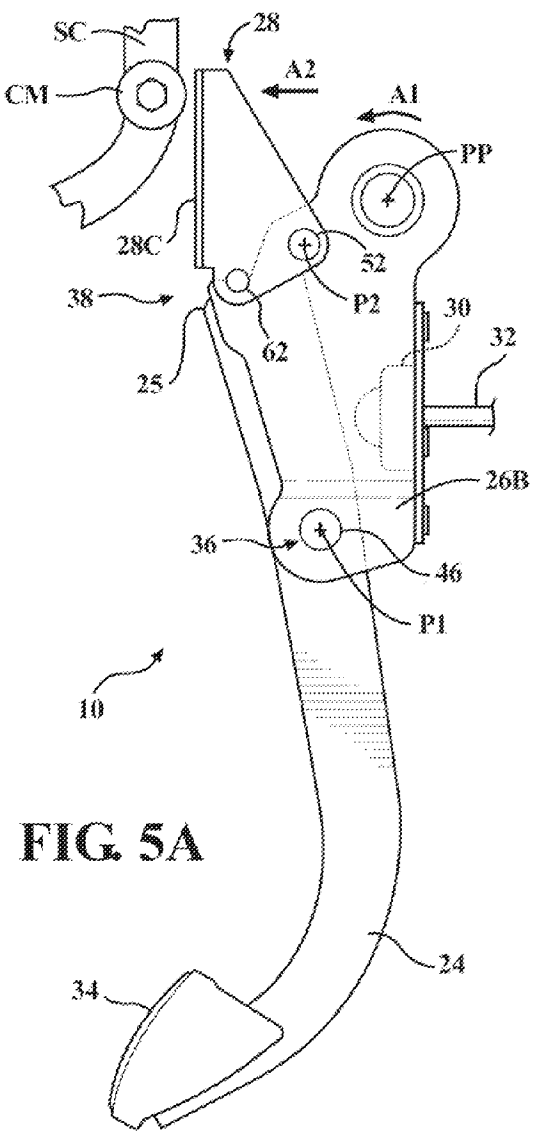

It is appreciated, of course, that the pedal assembly 10 is not limited to such a configuration. The cross member CM is optionally entirely separated from either the pedal assembly 10 and the mounting bracket 12, during normal operation, with the cross-member extending directly from the structural component SC, as best seen in FIGS. 5A-5C. Specifically, the cross-member CM is optionally fixedly secured, such being bolting or welding directly to the structural component SC, with no connection to the mounting bracket 12, or the cross-member CM is integrally formed as a one piece monolithic structure with the structural component SC.

The pedal assembly 10 is pivotally mounted to the between the pair of arms 16 by pivoting member 18 about a pedal pivot axis PP. The pedal assembly 10 includes a pedal arm 24, a swing bracket 26, and a striker plate 28. The swing bracket 26 includes a connector 30 which mechanically connects the pedal assembly 10 to a push rod 32, as best seen in FIGS. 5A-5C. The push rod 32 is attached to either a brake booster or a clutch operating mechanism depending on whether the pedal assembly 10 is a brake pedal assembly or a clutch pedal assembly, respectively.

The pedal arm 24 includes a pedal pad 34 at a lower distal end. The pedal arm 24 is pivotally connected to the swing bracket 26 at a primary connection 36, such that the pedal arm 24 is pivotal about a first pivot axis P1. The striker plate 28 is pivotally connected to an upper portion of the swing bracket 26 such that the striker plate 28 is pivotal about a second pivot axis P2. The striker plate 28 provides a secondary connection 38 between an upper end 25 of the pedal arm 24 and the swing bracket 26. As will be described in greater detail below, the secondary connection 38 is a fracturable connection which is in an engaged position during normal pedal operation and during vehicle collisions of sufficient magnitude the fracturable connected fractures and disengages the secondary connection 38.

During normal pedal operation, with the secondary connection 38 in an engaged position, the pedal arm 24 is provided with two points of connection with the swing bracket 38, and the upper end 25 of the pedal arm 24 is restrained at the secondary connection 38 such that the pedal arm 24 is prevented from pivoting about the first pivot axis P1 upon depression of the pedal pad 34. As such, during normal pedal operation depression of the pedal pad 35 causes the entire pedal assembly 10 to pivot about the pedal pivot axis PP. As the push rod 32 is connected to the swing bracket 26 through the connector 30, the pivotal movement of the pedal assembly 10 about pedal pivot axis PP transfers depression of the pedal pad 34 into operation of the brake booster or clutch operation mechanism, thereby, controlling operation of the brake and clutch mechanisms.

However, during a vehicle collision of sufficient magnitude the fracturable connected fractures and disengages the secondary connection 38. With the secondary connection 38, between the upper end 25 of the pedal arm 24 and the swing bracket 26, in the disengaged position, the upper end 25 of the pedal arm 24 is unrestrained and the pedal arm 24 is able to freely pivot about the first pivot axis P1 upon depression of the pedal pad 34. Specifically, as the secondary connection 38 is in the disengaged position, the pedal arm 24 is only connected to the swing bracket 26 at the primary connection 36, depression of the pedal pad 34 pivots the pedal arm 24 about the first pivot axis P1. As the pedal arm 24 pivots freely at the first pivot axis P1, the movement of the pedal arm 24 is prevented from being transferred to brake and clutch mechanisms as the push rod 32 is connected to the swing bracket 26.

Figure 2:
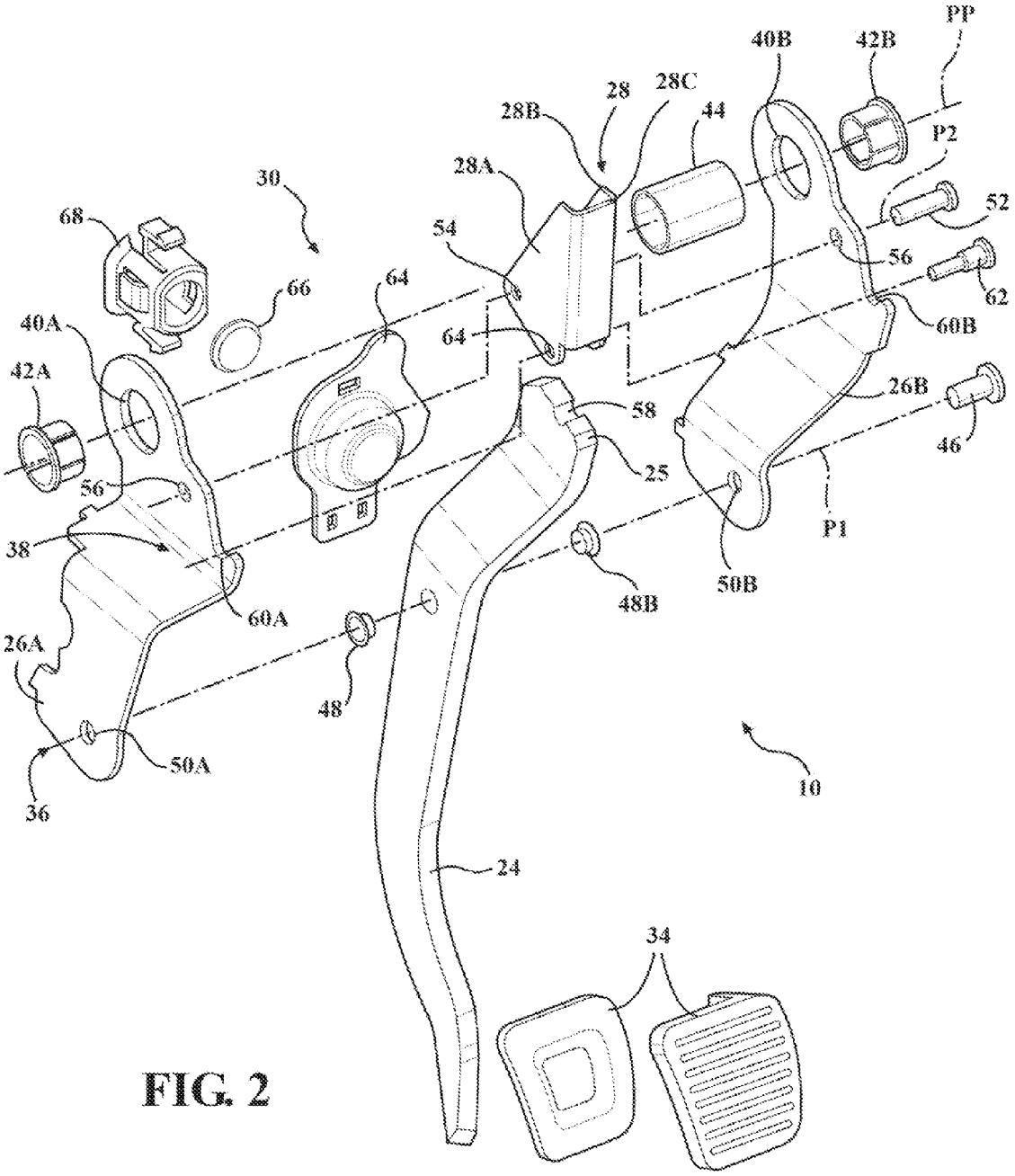
FIG. 2 is an exploded view of the pedal assembly.
Figure 3A:
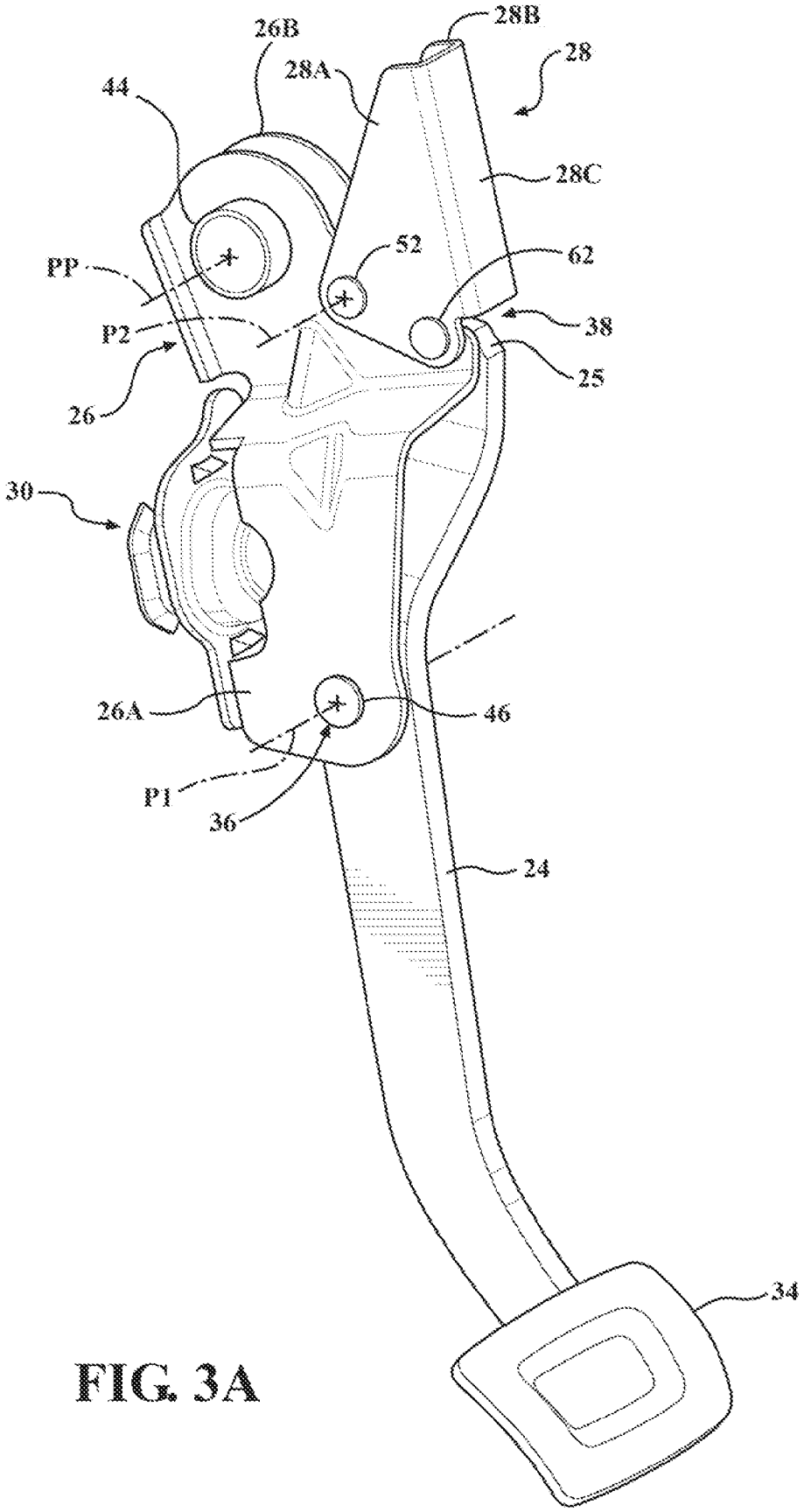
FIG. 3A is a front perspective view of the pedal assembly.
Figure 3B:
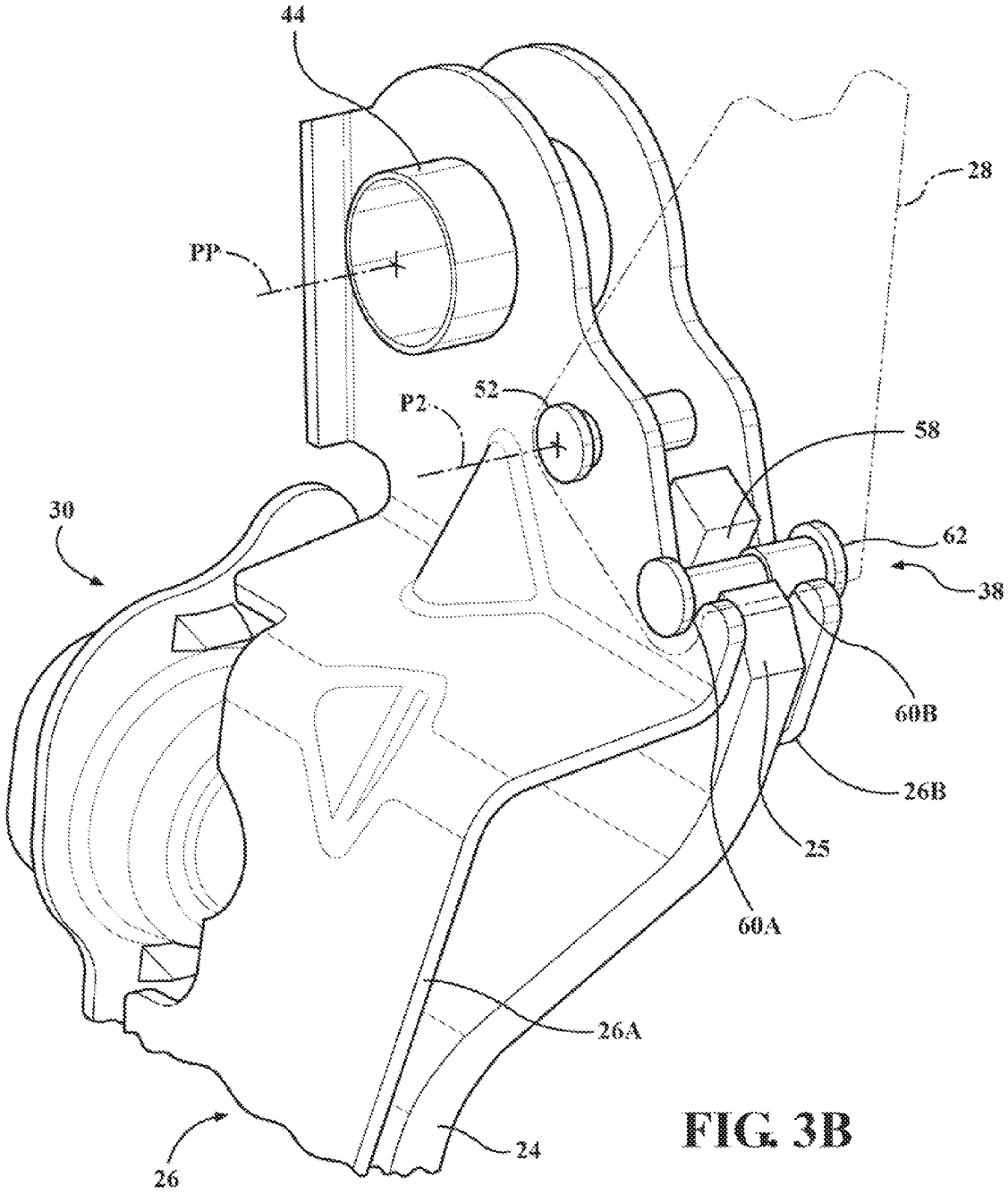
FIG. 3B is an enlarged partial perspective view of the pedal assembly with a transparent striker plate.
Figure 4:
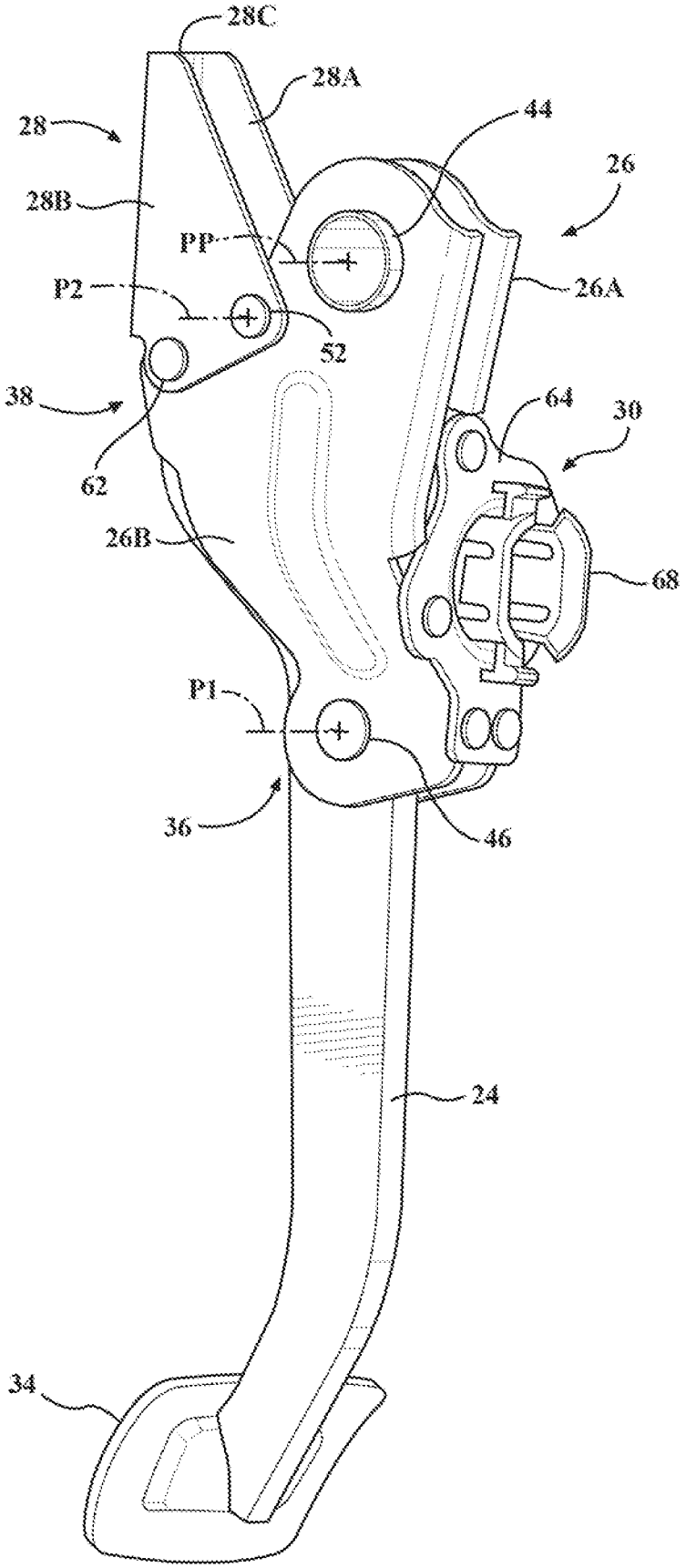
FIG. 4 is a rear perspective view of the inventive pedal assembly.

With reference to FIG. 2-4, additional details of the structural configuration of the pedal assembly 10 will be provided. The swing bracket 26 includes a pair of swing plates 26A and 26B each of which having an aperture 40A and 40B. Bushings 42A and 42B are provided in each of the swing plates 26A and 26B and a hub 44 extends therethrough. The pivoting member 18 extends through the apertures 40A and 40B of the swing plates 26A and 26B and the bushings 42A and 42B, and hub 44 to pivotally mount the pedal assembly 10 to the pair of arms 16 of the mounting bracket 12 about pedal pivot axis PP.

The pedal arm 24 is provided between the pair of swing plates 26A and 26B. The primary connection 36 includes a pivot pin 46 and bushings 48A and 48B that extends through a generally central portion of the pedal arm 24 and apertures 50A and 50B formed in a lower portion of each of the swing plates 26A and 26B such that the pedal arm 24 pivots about a first pivot axis P1. The primary connection 36 and the first pivot axis P1 is positioned on the pedal arm 24 at a point between the pedal pad 34 and the upper end 25.

The striker plate 28 is formed having a generally U-shaped cross-section with a pair of side walls 28A and 28B and an impact or traversing wall 28C extending between the pair of side walls 28A and 28B. The pair of side walls 28A and 28B are formed having a generally triangular shape. The striker plate 28 is pivotally attached to the swing bracket 26 about the second pivot axis P2 by a pivot pin 52 which extends through apertures 54 formed in each of the pair of side walls 28A and 28B and apertures 56 formed in each of the pair of swing plates 26A and 26B.

As seen in FIGS. 3A, 3B and 4, the swing bracket 26 is positioned within the striker plate 28. Specifically, the pair of side walls 28A and 28B are positioned on an exterior surface of each of the swing plates 26A and 26B. The positioning of the swing bracket 26 within the channel formed by the U-shaped cross section of the striker plate 28 allows the striker plate 28 to rotate or pivot about the second pivot axis P2.

The secondary connection 38 between the pedal arm 24, the swing bracket 26 and the striker plate 28 is formed as a fracturable or frangible connection between the pedal arm 24 and the striker plate 28. Specifically, the upper end 25 of the pedal arm 24 is formed with a notch 58. Each of the swing plates 26A and 26B are formed with a recess 60A and 60B which correspond with the notch 58. As best seen in FIG. 3B, a pin 62 extends through apertures 64 formed in each of the pair of side walls 28A and 28B. The pin 62 is press fit into the notch 58 and received within the recesses 60A and 60B to provide the secondary connection 38 between the pedal arm 24, the swing bracket 26, and the striker plate 28.

As stated above, the two points of connection between the pedal arm 24 and the swing bracket 26 prevent the pedal arm 24 from freely pivoting about the first pivot axis P1. Thus, driver is operable to actuate the brake or clutch mechanism by depressing the pedal pad 34 such that the pedal arm 24, swing bracket 26, and striker plate 28 pivot around pedal pivot axis P1. The engagement between the pin 62 within the notch 58 and the recesses 60A and 60B is an interference fit such that during normal operation of the pedal arm 24, the pin 62 prohibits the pivoting of the pedal arm 24 about the first pivot axis P1 and maintains a two point connection between the pedal arm 24, the swing plate 26, and the striker plate 28. It is appreciated, of course, that the pin 62 is optionally press fit into recesses 60A and 60B of the swing bracket 26 in a similar manner as the notch 58.

The secondary connection 38 is a frangible connection due to the interference fit between the notch 58, the recesses 60A and 60B, and the pin 62. The notch 58 is optionally formed as an opening in the upper end 25 of the pedal arm 24 with a diameter generally equal to the diameter of the pin 62. A slot extends from the opening to the exterior of the upper end 25 of the notch 58, with the slot having a length less than the diameter of either the notch 58 or the pin 62. Upon press fitting the pin 62 within the notch 58, the secondary connection 38 is in an engaged position until a force exceeding a predetermined fracture or disengagement force is applied wall 28C of the striker plate 28 which urges the striker plate 28 to rotate about the second pivot axis P2 thereby stressing the engagement of the notch 58 and pin 62. As an example the predetermined fracture or disengagement force is e.g. 2000 N; however, the predetermined fracture or disengagement force is variable depending upon each vehicle application or and prevailing governmental standards The connector 30 includes a cover 64, an end cap 66, and a clip member 68. The clip member 68 receives a distal end of the push rod 32 having a ball-shaped protrusion which is restrained within the end cap 66 and the cover 64 during pivoting of the pedal assembly 10 about the pedal pivot axis PP. The cover 64 is secured to the swing bracket 26 and the end cap 66 is positioned between the cover 64 and the clip member 68. The clip member 68 is secured to the cover 64 through a plurality of external snap tabs. The distal end of the push rod 32 is restrained within the clip member through a plurality of internal snap tabs. Once the pedal assembly 10 has been pivotally attached to the mounting bracket 12, the connector 30 is secured to the push rod 32 merely by depressing the pedal pad 34 as the distal end of the push rod 32 enters the clip member 68 and is restrained by the internal snap tabs. As the clip member 68 is secured to the pedal assembly 10 by the attachment of the clip member 68 to the cover 64, the push rod 32 mechanically connected to the pedal assembly 10.

In order to facilitate a better understanding of the pedal assembly, the operation of the pedal assembly 10 during normal operation and during a vehicle collision of sufficient magnitude will now be discussed in relation to FIGS. 5A-5C.

As seen in FIG. 5A, during normal operation of the pedal assembly 10, when a driver depresses the brake pad 34 of the pedal arm 24, which is rigidly connected to the swing plate 26 by the primary connection 36 and the secondary connection 38, the pedal arm 24 will rotate about the pedal pivot axis PP in the direction of arrow A1, thereby forcing the push rod 32, which is received within the connector 30, forwardly in the vehicle longitudinal direction. As such, depression of the pedal pad 34 will actuate the brake or clutch mechanism in order to control the operation of the vehicle. In normal operation, the secondary connection 38 is in the engaged position and the cross-member CM is spaced apart from an impact surface of the wall 28C of the striker plate 28. In the alternative, the cross-member CM is optionally positioned adjacent the impact surface of the wall 28C of the striker plate 28 without imparting a force.

In the event of a front vehicle collision of sufficient magnitude, in which the front portion of the vehicle is pushed towards the rear portion of the vehicle, firewall FW including the mounting bracket 12 and the pedal assembly 10 will be forcibly displaced rearward in the direction of arrow A2. The movement of the pedal assembly 10 the rearwardly facing impact surface of wall 28C of the striker plate 28 to impact the cross member CM.

It is appreciated, of course, in the embodiment of FIG. 1, the forcible displacement of the firewall FW including the mounting bracket 12 and the pedal assembly 10, will rupture the break tab 22 from the strut 20 of the mounting bracket 12, thereby providing the cross-member CM to remain stationary with respect to the pedal assembly during a front vehicle collision of sufficient magnitude.

The force of the impact between the impact wall 28C of the striker plate 28 and the cross member CM, the striker plate 28 will be urged to rotate about the second pivot axis P2 in the direction of arrow A3. When the impact force is less than the predetermined fracture or disengagement force of the secondary connection 38, the fracturable connection between the notch 58 and the pin 62 is maintained and the two point connection of the pedal arm 24 is maintained such that pedal arm 24 is prevented from pivoting about the first pivot axis P1.

As best seen in FIG. 5B, when the impact force of the cross-member CM against the impact wall 28C of the striker plate 28 equals or exceeds the predetermined fracture or disengagement force, the moment acting on the secondary connection 38 will cause the disengagement of the interference fit of the notch 58 and the pin 62 and the recesses 60A and 60B of the swing bracket 26. As such, the striker plate 28 pivots about the second pivot axis P2 in the direction of arrow A3 and the secondary connection 38 is moved from the engaged position (FIG. 5A) to the disengaged position (FIGS. 5B and 5C).

The disengagement of the pin 62 from the notch 58 of the upper end 25 of the pedal arm 24, due to the rotation of the striker plate 28 about second pivot axis P2, releases the two-point connection of the pedal arm 24 and the upper end 25 of the pedal arm 24 is no longer retrained by the secondary connection 38. As such, the pedal arm 24 is merely attached to the swing bracket 26 at the pivotal primary connection 36 by pin 46 and the pedal arm 24 is allowed to freely pivot about the first pivot axis P1 in the direction of arrow A4, as best seen in FIG. 5C, due to the driver's depression of the brake pad 34. As the pedal arm 24 is allowed to freely pivot about the first pivot axis P1, the pedal assembly 10 is prevented from acting as a rigid member and the impact force of the vehicle collision is prevented from being transferred to the foot of the driver on the pedal pad 34.

Figure 6:
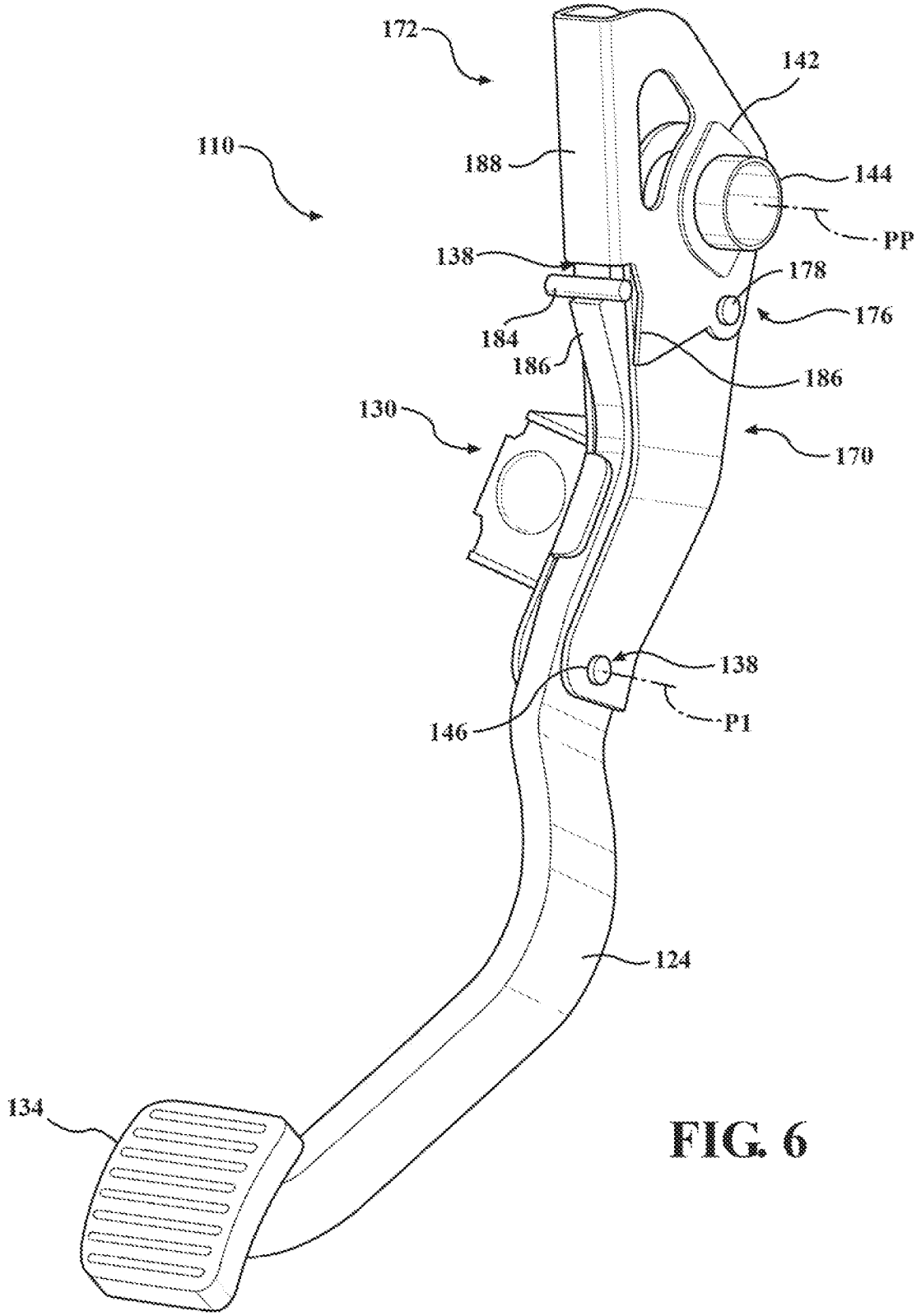
FIG. 6 is a front perspective view of an alternative configuration of the pedal assembly.

An alternative configuration of the pedal assembly is generally disclosed at 110 in FIG. 6. The pedal assembly 110 is mounted to a mounting bracket (not shown) mounted to the vehicle, as described above, about a pedal pivot axis PP. The pedal assembly includes a pedal arm 124, a swing bracket 170 having a connector 130, and a striker plate 172. The pedal arm 124 includes a pedal pad 134 positioned at a distal end thereof.

The connector 130 is similar to the connector 30 described above and mechanically connects the pedal assembly 110 to a push rod thereby providing a mechanical connection between the pedal assembly 110 and either a brake mechanism or a clutch mechanism.

The pedal arm 124 is pivotally connected to the swing bracket 170 at a primary connection 136, such that the pedal arm 124 is pivotal about a first pivot axis P1. The swing bracket 170 is formed having a generally U-shaped cross-section. The swing bracket 170 includes a pair of side walls 170A and 170B, a traversing wall 170C. The traversing wall 170C and the pair of side walls 170A and 170B defines a channel 170D which receives a portion of the pedal arm 124, as best seen in FIG. 7.

The upper end 125 of the pedal arm 124 is positioned within the rearwardly facing, in the vehicle longitudinal direction, channel 170D of the swing bracket 170. The striker plate 172 is pivotally connected to the swing bracket 170 about hub 144 for pivotal movement about the pedal pivot axis PP. The striker plate 172 includes a pair of generally triangular shaped sides 172A and 172B and an impact or traversing wall 172C extending between the pair of sides 172A and 172B. The traversing wall 172C includes an exterior impact surface 188 and an opposite interior abutment surface 190.

The striker plate 172 provides a secondary connection 138 between an upper end 125 of the pedal arm 124 and the swing bracket 26. As will be described in greater detail below, the secondary connection 138 is an abutment connection which is in an engaged position during normal pedal operation and during vehicle collisions of sufficient magnitude the striker plate 172 rotates freeing the upper end 125 of the pedal arm 124 and disengages the secondary connection 138.

Figure 7:
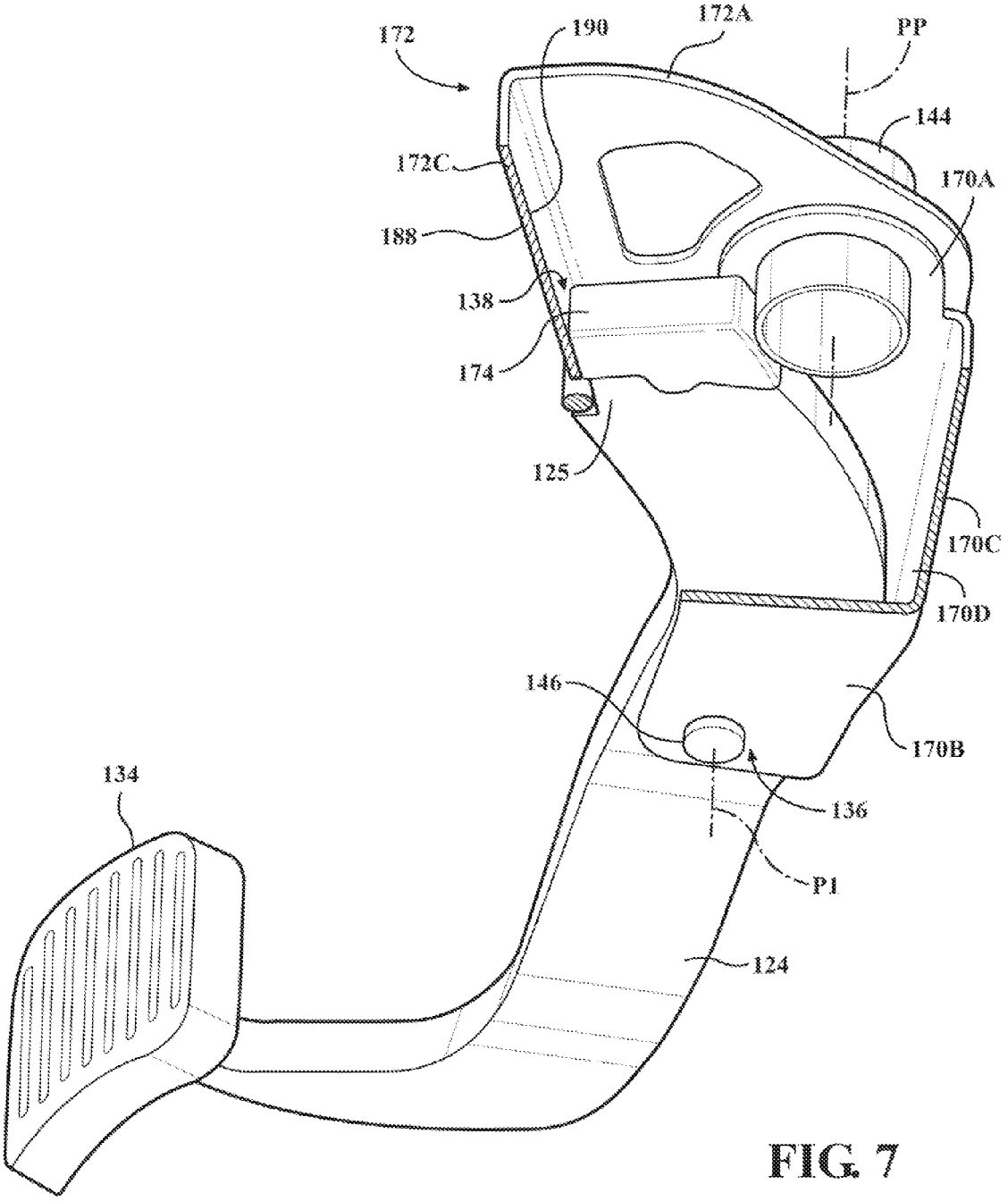
FIG. 7 is a perspective partial cross-sectional view of the alternative pedal assembly.

As clearly shown in FIG. 7, the striker plate 172, specifically the side walls 172A and 172B, are positioned on the exterior of the side walls 170A and 170B of the swing bracket 170. In the engaged position the secondary connection 136 is provided between the abutment of the upper portion of the pedal arm 124 and the striker plate 172. Specifically, the secondary connection 138 is provided by the abutment of a cover 174 at the upper portion 125 of the pedal arm 112 and the interior abutment surface 190 of the traversing wall 172C of the striker plate 172.

The cover 174 is formed of a polymeric material so as to provide an interference fit between the upper end 125 of the pedal arm 124 and the interior surfaces of the side walls 170A and 170B of the swing bracket 170 and the interior abutment surface 190 of the traversing wall 172C of the striker plate 172. The cover 174 absorbs space tolerances to prevent rattling of the pedal arm 124 within the swing bracket 170 and the striker plate 172 thereby decreasing noise and vibration.

Figure 8:
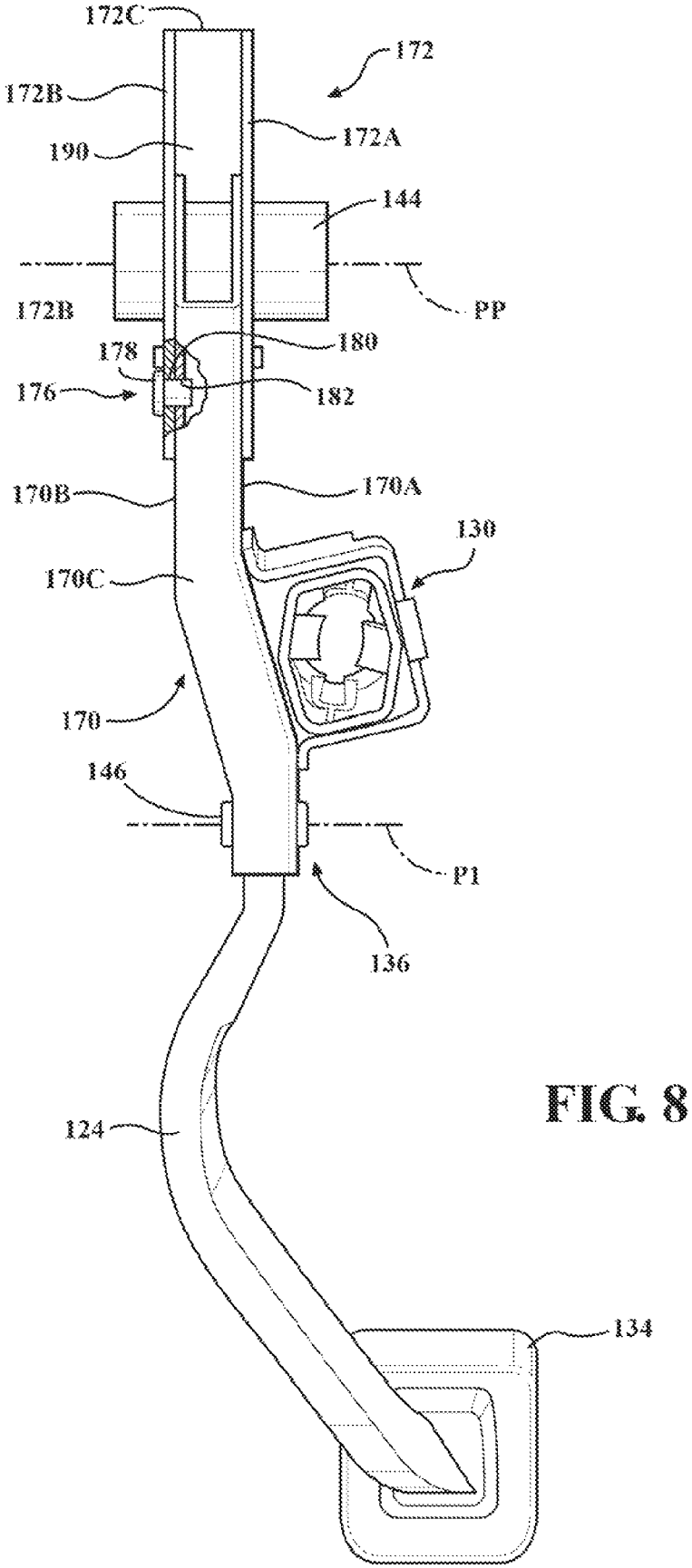
FIG. 8 is a rear view of the alternative pedal assembly.

In order to secure the secondary connection 138 in the engaged position, i.e. to position the striker plate 172 and the swing bracket 120 in the engaged positions, as shown in FIGS. 6, 7, and 8, a fracturable or frangible connection 176 is provided between the striker plate 172 and the swing bracket 170. Specifically, the frangible connection 176 is in the form of a shearable pin 178 extending through aperture 180 in the side wall 172B of the striker plate 172 and aperture 182 in the side wall 170B in the swing bracket 116, respectively. The shearable pin 178 is designed to shear upon the application of a predetermined fracture or disengagement force impacting on the impact surface 188 of the striker plate 172 due to the urging of the striker plate 172 to rotate about the pedal pivot axis PP.

The engagement of shearable pin 178 acting as the fracturable connection 176 and the abutment of the upper end 125 of the pedal arm and the abutment surface 190 of the traversing wall 172C of the striker plate 172 acting as the secondary connection 138, provides a rigid connection between the pedal arm 124, the swing bracket 170, and the striker plate 172 that restrains the pedal arm 124 from freely pivoting about the first pivot axis P1. The primary connection 136 and the secondary connection 138, which is retained in the engaged position by the frangible connection 176, provides the two-point connection of the pedal arm 124 to depression of the pedal pad 134 to pivot the pedal assembly 110 about the pedal pivot axis PP.

The striker plate 172 includes guides edges 186 which are formed as portions of the each of the pair of side walls 172A and 172B. The guide edges extend 186 downwardly beyond of the traversing wall 172C of the striker plate 172. The upper end 125 of the pedal arm 124 includes a traversely extending rod 184. The rod 184 has a width greater than the width of the striker plate 172 and the pedal arm 124. During rotation of the striker plate 172, as will be described in greater detail below, the guide edges 186 abut the rod 184 and force the rotation of the upper end 125 of the pedal arm 124 about the first pivot axis P1.

In order to facilitate a better understanding of the pedal assembly 110, the operation of the pedal assembly 110 during normal operation and during a vehicle collision of sufficient magnitude will now be discussed in relation to FIGS. 9A-9C.

Figure 9C:
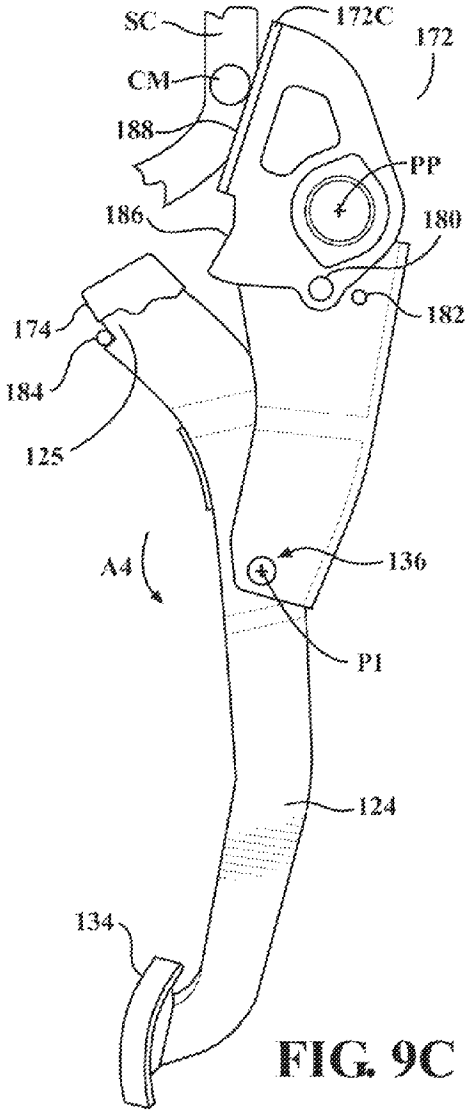
FIGS. 9A-9C are side views illustrating the operation of the alternative pedal assembly during a vehicle collision.
Figure 9B:
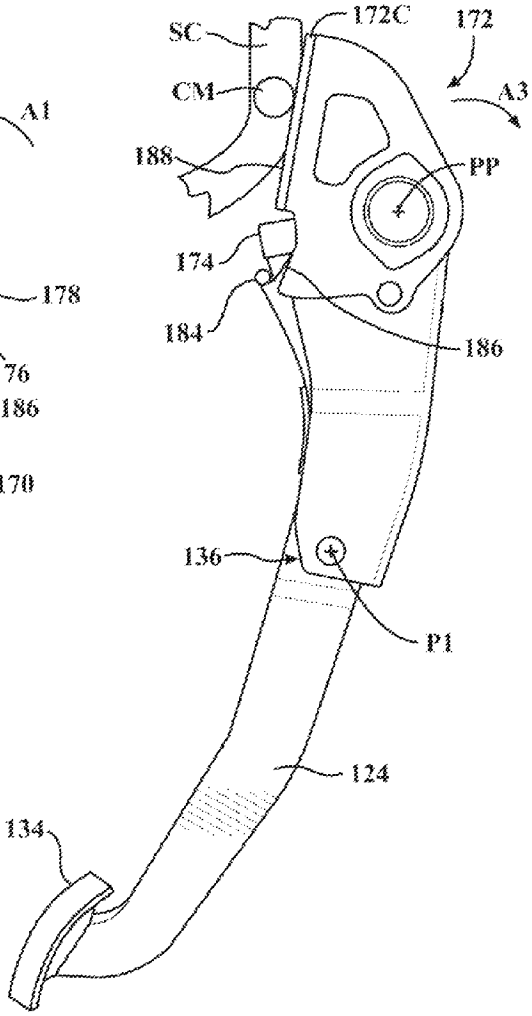
Figure 9A:
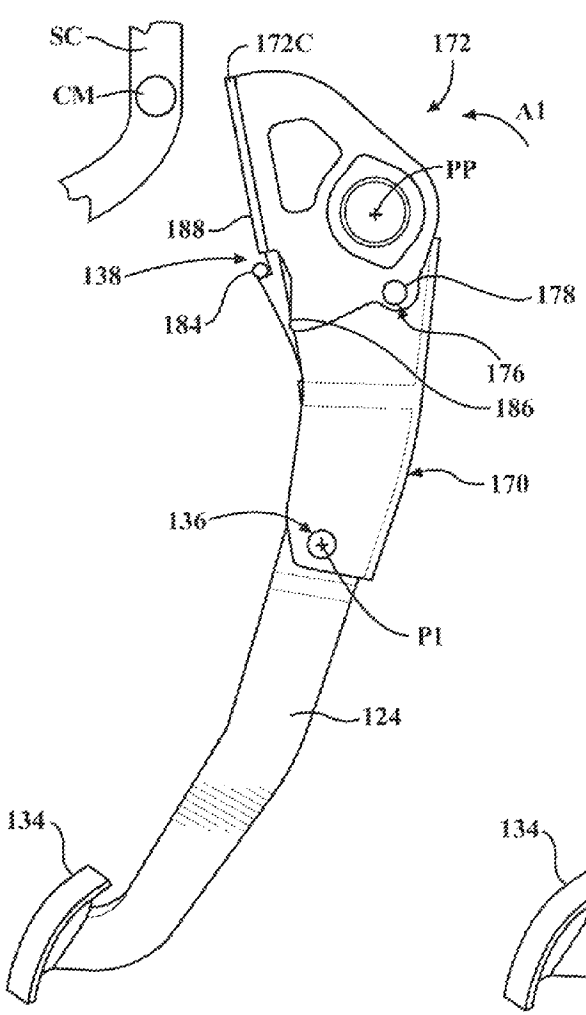

As seen in FIG. 9A, during normal operation of the pedal assembly 110, when a driver depresses the brake pad 134 of the pedal arm 124, which is rigidly connected to the swing bracket 170 and the striker plate 172 by the two-point connections of the primary connection 136 and the secondary connection 138, the pedal arm 124 will rotate about the pedal pivot axis PP in the direction of arrow A1, thereby forcing the push rod, which is received within the connector 130, forwardly in the vehicle longitudinal direction. As such, depression of the pedal pad 134 will actuate the brake or clutch mechanism in order to control the operation of the vehicle.

In normal operation, the secondary connection 138 is in the engaged position and the cross-member CM is spaced apart from an impact surface 188 of the traversing wall 172C of the striker plate 172. In the alternative, the cross-member CM is optionally positioned adjacent the impact surface 188 of the wall 172C of the striker plate 172 without imparting a force.

In the event of a front vehicle collision of sufficient magnitude, in which the front portion of the vehicle is pushed towards the rear portion of the vehicle, firewall FW including the mounting bracket 12 and the pedal assembly 110 will be forcibly displaced rearward in the direction of arrow A2. The movement of the pedal assembly 110 causes the rearwardly facing impact surface 188 of wall 172C of the striker plate 172 to impact the cross member CM.

The force of the impact between the impact surface 188 of wall 172C of the striker plate 172 and the cross member CM, the striker plate 172 will be urged to rotate about the pedal pivot axis PP in the direction of arrow A3. When the impact force is less than the predetermined fracture or disengagement force of the fracturable connection 176 between shearable pin 178 and the side wall 172B and 170B, the shearable pin 176 is not fractured and the two point connection of the pedal arm 124 is maintained such that pedal arm 124 is prevented from pivoting about the first pivot axis P1.

As best seen in FIG. 9B, when the impact force of the cross-member CM against the impact surface 188 of wall 172C of the striker plate 172 equals or exceeds the predetermined fracture or disengagement force, the shear stress acting on the shearable pin 176 will rupture the shearable pin 178 fracturing the fracturable connection 176. As such, the striker plate 172 pivots about the pedal pivot axis PP in the direction of arrow A3 and the secondary connection 138 is moved from the engaged position (FIG. 9A) to the disengaged position (FIG. 9B).

The rupture of the shearable pin 178, due to the rotation of the striker plate 172 about pedal pivot axis PP, releases the two-point connection of the pedal arm 124 and the upper end 125 of the pedal arm 124 is no longer retrained by the secondary connection 38. Specifically, the rotation of the striker plate 172 removes the abutment between the cover 174 (upper end 125 of the pedal arm 124) and the inner abutment surface 190 of the traversing wall 172C of the striker plate 172.

Due to the rotation of the striker plate 118, the guide edges 186 of the striker plate 172 come into contact with the rod 184 of the pedal arm 124. The further rotation of the striker plate 172 causes the guide edges 186 to push the rod 184 and the upper end 125 of the pedal arm 124 in the direction of arrow A4 so as to rotate the pedal arm 124 about the first pivot axis P1.

As such, the pedal arm 124 is merely attached to the swing bracket 170 at the pivotal primary connection 136 by pin 146 and the pedal arm 124 is allowed to freely pivot about the first pivot axis P1 in the direction of arrow A4, as best seen in FIG. 9C, due to the driver's depression of the brake pad 134. As the pedal arm 124 is allowed to freely pivot about the first pivot axis P1, the pedal assembly 110 is prevented from acting as a rigid member and the impact force of the vehicle collision is prevented from being transferred to the foot of the driver on the pedal pad 134.

The present invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

It is claimed:

1. A pedal assembly for an automotive vehicle having a mounting bracket and a stationary cross member, said pedal assembly comprising:

a swing bracket pivotally mounted to the mounting bracket about a pedal pivot axis;

a striker plate pivotally mounted to said swing bracket; and a pedal arm pivotally mounted to said swing bracket at a first pivot axis, said pedal arm having a secondary connection on said pedal arm to at least one of-between said pedal arm, said striker plate and said swing bracket to allow said swing bracket and said pedal arm to pivot about said pedal pivot axis upon depression of a pedal pad, said striker plate rotates upon contact with the cross member during a vehicle collision, said rotation of said striker plate disengages said secondary connection of said pedal arm to allow said pedal arm to freely pivot, relative to said swing bracket, about said first pivot axis wherein said striker plate is pivotally connected to said swing bracket about a second pivot axis, said second pivot axis positioned between said pedal pivot axis and said first pivot axis, wherein said secondary connection is a connection between said pedal arm and said striker plate, said connection fractures upon application of a predetermined force by the cross-member on said striker plate during the vehicle collision, and wherein upon fracture of said connection said striker plate pivots about said second pivot axis and disengaging said secondary connection and allowing said pedal arm to freely pivot about said first pivot axis, wherein said connection includes a pin in one of said striker plate and an upper portion of said pedal arm, and a notch formed in the other of said striker plate and said upper portion of said pedal arm, and whereupon application of said predetermined force upon said striker plate said pin disengages from said notch fracturing said connection, wherein said swing bracket is a pair of swing plates pivotally connected to the mounting bracket about said pedal pivot axis, and wherein a portion of said pedal arm is positioned between said pair of swing plates, wherein said striker plate has a pair of sides and a traversing wall between said pair of sides, said traversing wall having an impact surface that contacts the cross member, and wherein each of said pair of sides of said striker plate is positioned on an exterior of said pair of swing plates.

2. The pedal assembly of claim 1, wherein each of said pair of swing plates includes a recess which corresponds to said notch formed in said upper portion of said pedal pad, and wherein said pin of said striker plate is positioned within said recesses and said notch when said secondary connection is engaged.

3. The pedal assembly of claim 2, wherein said impact surface of said striker plate extends upwardly beyond said pedal pivot axis.

* * * * *